US008820262B2

(12) United States Patent
Muller

(10) Patent No.: US 8,820,262 B2
(45) Date of Patent: Sep. 2, 2014

(54) POSITIVE CONTROL FOR WATERCRAFT PLATFORM

(76) Inventor: Peter A. Muller, Gattikon (CH)

( * ) Notice: Subject to any disclaimer, the term of this patent is extended or adjusted under 35 U.S.C. 154(b) by 272 days.

(21) Appl. No.: 12/452,620

(22) PCT Filed: Jul. 11, 2008

(86) PCT No.: PCT/CH2008/000314

§ 371 (c)(1),
(2), (4) Date: Mar. 1, 2010

(87) PCT Pub. No.: WO2009/006753

PCT Pub. Date: Jan. 15, 2009

(65) Prior Publication Data

US 2010/0212576 A1 Aug. 26, 2010

(30) Foreign Application Priority Data

Jul. 12, 2007 (CH) ..... 1126/07

(51) Int. Cl.
*B63B 17/00* (2006.01)
*B63B 27/16* (2006.01)

(52) U.S. Cl.
CPC ..... *B63B 27/16* (2013.01)
USPC ..... 114/362

(58) Field of Classification Search
USPC ..... 114/264, 343, 362, 364, 366; 414/549, 414/541, 535
See application file for complete search history.

(56) References Cited

U.S. PATENT DOCUMENTS

| | | | | | |
|---|---|---|---|---|---|
| 4,627,377 | A | * | 12/1986 | Zoonens | 114/373 |
| 4,693,080 | A | * | 9/1987 | Van Hooff | 60/414 |
| 4,697,538 | A | * | 10/1987 | Day | 114/230.16 |
| 5,690,045 | A | | 11/1997 | Gauthier | |
| 6,021,733 | A | * | 2/2000 | Jaramillo, Sr. | 114/362 |
| 6,164,895 | A | * | 12/2000 | Croswell | 414/462 |
| 6,298,801 | B1 | * | 10/2001 | May | 114/85 |
| 6,327,992 | B1 | * | 12/2001 | Martin | 114/259 |
| 6,786,170 | B2 | * | 9/2004 | Trowbridge | 114/259 |

FOREIGN PATENT DOCUMENTS

| | | | |
|---|---|---|---|
| DE | 196 02 331 | A1 | 7/1997 |
| GB | 2 372 495 | A | 8/2002 |
| WO | WO 99/10229 | A | 3/1999 |
| WO | WO 2007/087736 | A | 8/2007 |

* cited by examiner

*Primary Examiner* — Lars A Olson
*Assistant Examiner* — Andrew Polay
(74) *Attorney, Agent, or Firm* — Oliff PLC

(57) ABSTRACT

The invention relates to a variable-height platform, which is fitted to a watercraft and has an additional travel and/or a longitudinally movable mounting plate, by positive control such that obstructions in the pivoting area can be fully bypassed without long pivoting arms and special linear-movement cylinders, and a reasonable immersion depth of the platform is ensured in all cases and, in the event of failure of the linear-movement cylinder, the platform can always be moved to the position A by an energy store or accumulator.

3 Claims, 4 Drawing Sheets

POSITIVE CONTROL FOR WATERCRAFT PLATFORM

This application claims priority of PCT application PCT/CH2008/000314 having a priority date of Jul. 12, 2007, the disclosure of which is incorporated herein by reference.

TECHNICAL FIELD

The invention is based on an adjustable drop down and coercion controlled moving platform for picking up tender and persons on watercraft.

BACKGROUND OF THE INVENTION

Drop down platforms for swimmers, divers and for tender vessels are known, as described in patents DE 196 02 331, U.S. Pat. No. 6,327,992, U.S. Pat. No. 5,690,045, enabling persons or material to be lowered comfortably into the water or to be taken on board.

Surface piercing drives, which have a relatively long propeller shaft placed just under the waterline behind the transom of the watercraft, is for example a drop down swim platform only possible with an electric or hydraulically activated horizontal sliding of the platform, which then can be lowered behind the propeller

SUMMARY OF THE INVENTION

The invention involves a drop down platform mounted at the transom of a watercraft for reason to pick up persons or a tender or to be lowered into the water, to generate an additional lift by means of mechanical means so that the lifting stroke is finally larger as that would be possible with a given cylinder or given swiveling arm kinematics as well as to have a controlled radius to bypass technical mean attached at the transom of a watercraft or to keep the drop down movement of the platform closer to the watercraft transom, to keep e.g. the gap between the watercraft and platform small.

Drop down tender and swim platforms have a limited market, if these devices are produced in series with the most possible structurally identical parts as the transoms of the craft differ in a high extent in height and draught. In addition the hulky technical means on watercraft's transoms make it impossible to have a comfortable utilization of such lowering devices e.g. by protruding rudder blades, jet nozzles, transom drives, trim tabs and therefore additionally limit the assembly and utilization of such drop down platforms.

Long pivoting arms to avoid the hulky technical means would affect to a large extent the side stability of the pivoting arms and therefore would have to be dimensioned accordingly and would therefore increase the weight at the transom with the result that the transom would have to be reinforced as well.

The invention solves the stroke limitation due to stroke limited cylinders, or narrow space in the transom area or because of the protruded technical means or because of the limited pivot arms length due to safety reasons, by means of mechanical add-on stroke means, generating an additional lift and thereby can be mounted onto a large number of craft enabling a larger amount of persons to be able to get in or out of the water as well as allowing tender boats to be easily loaded or unloaded. In case of a technical failure of a hydraulic cylinder, by means of stored energy e.g. by a gas spring, it can be ensured that the platform may always be returned to its initial position.

Quintessence of the invention is that by means of a drop down swim platform to generate an additional lift as well with limited cylinder dimensions or limited pivoting arm dimensions or stroke hindrances by means of mechanical forced adjustment mean, an accordingly stroke radius is generated so as to go around hindrances in a simple and safe way and in every event to attain elegantly an additional drop down stroke and in an emergency by means of stored energy the platform may be returned to its home position.

BRIEF DESCRIPTION OF THE DRAWINGS

Various exemplary aspects of the invention will be described with reference to the drawings, wherein.

Only essential elements of the invention are schematically shown to facilitate immediate understanding.

DETAILED DESCRIPTION OF THE PREFERRED EMBODIMENTS

Figure 1:
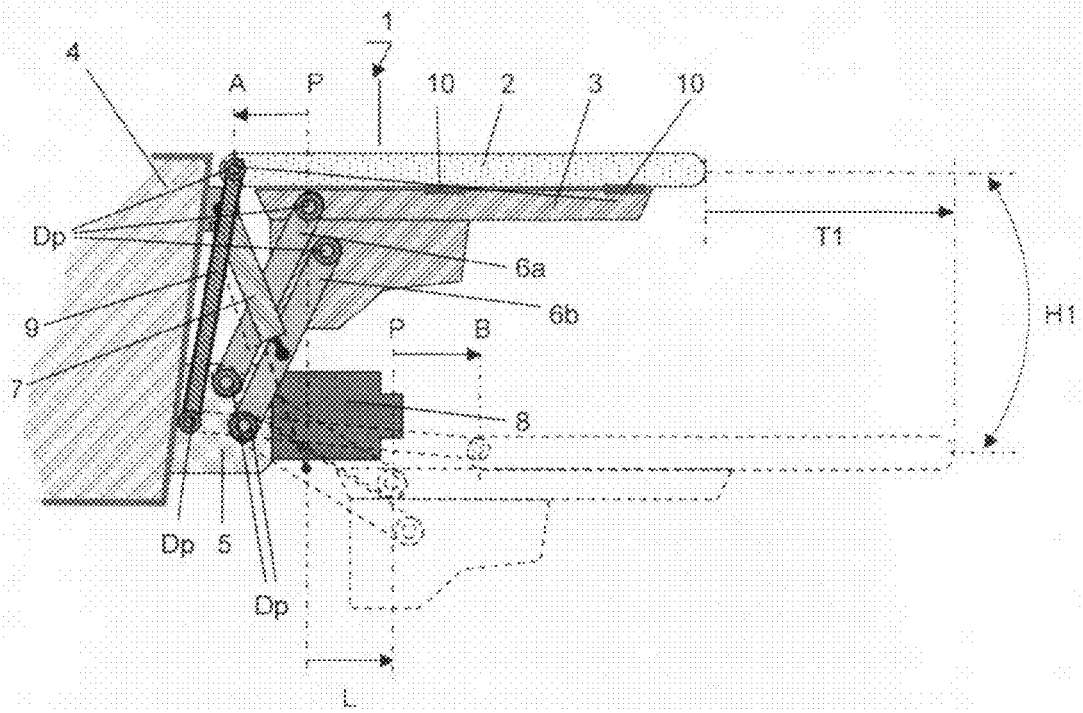
FIG. 1—A schematic side view of a drop down platform with a set of cantilever pivot arms and cylinder attached to a console, as well as a steering rod between the console and the platform, as well as a shifting mean.

FIG. 1 shows a schematic side view of a drop down platform 1 consisting of panel 2 and the platform chassis 3, which is situated on transom 4 of a watercraft. The console 5 is attached to the transom 4, onto which pivoting arms 6 are hinged, consisting of cantilever pivoting arms 6*a*, 6*b*, by which platform 1 is supported and lift guided. Between the platform chassis 3 and the panel 2 a shifting means 10 is attached, which guides and holds panel 2 with a minimum of friction. By means of cylinder 7, which is on the one hand attached to transom 4 and on the other hand attached to the pivoting arms 6*a*, 6*b* the lift H1 is set and fixed. The appropriate arm lengths, respectively the pivot points on the cantilever pivoting arms 6, yields the radius on platform 1. In case technical means 8 are attached at the lower part of transom 4, for example stern drive, rudder, trim tabs, jets etc., it may happen therefore that the panel 2, as a result of the given radius, cannot be pivoted around the technical means 8.

For this reason the invention makes provision that the panel 2, with a simple means, shown here by the steering bar 9, can be lengthwise coercion shifted to avoid a hindrance. The steering bar 9 is on the one hand fixed to the console 5 and on the other hand to the panel 2 through the preferred but not mandatory different length of the steering bar 9. In accordance with the position of the pivoting arms 6*a*, 6*b* and/or the pivot points Dp and/or the upper pivot points Dp, panel 2 will be shifted by the shifting means 10, while activating the lift, over the platform chassis 3 accordingly, and at the same time shifted mechanically, e.g. from position A via the reference position P to position B. In other words, when the pivoting arms 6*a*, 6*b* raise or lower the platform chassis 3, the panel 2 is maintained at a horizontal attitude relative to the horizon and the panel 2 moves horizontally relative to the platform chassis 3. Thereby, panel 2 can be elegantly and absolutely mechanically pivoted around the technical means 8, which are situated between or next to the cantilever pivoting arms 6. The total distance T1 of panel 2 away from transom 4 comprises deflection radius L of the cantilever arms 6 and the lengthwise shifting distance from A to B.

Figure 2:
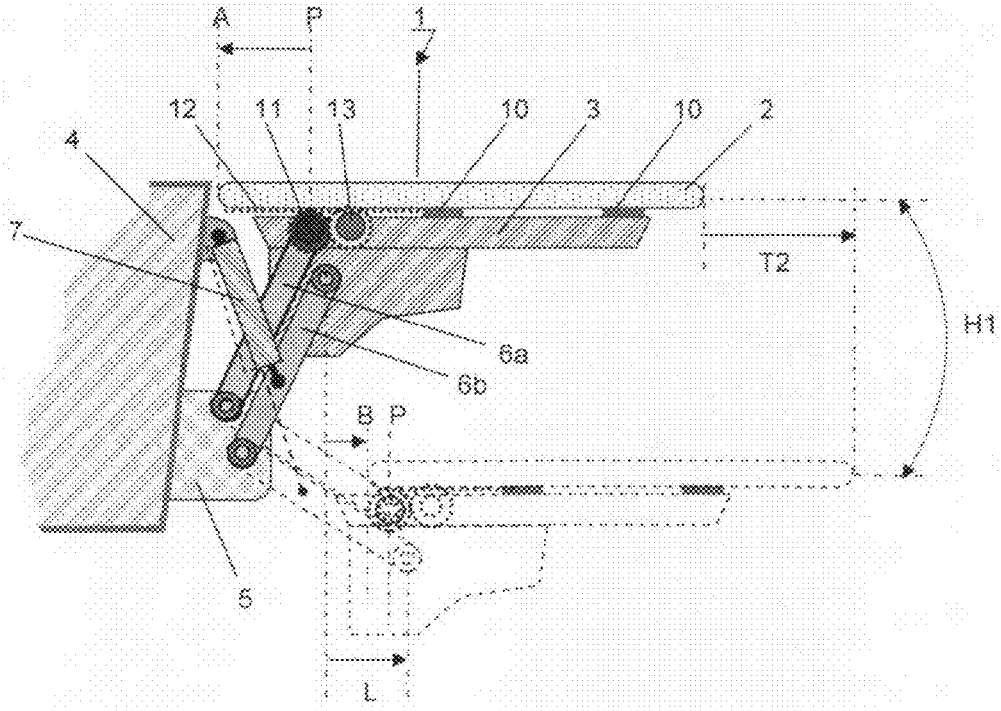
FIG. 2—A schematic side view of a drop down platform with a set of cantilever pivot arms and cylinder attached to a console, as well with a gear wheel and transmission between platform chassis and platform having beneath a rack and pinion mean as well as a shifting mean FIG. 3—A schematic side view of a drop down platform with a set of cantilever pivot arms and cylinder attached to a console and attached to the platform a guidenut and a cranked pivoting arm with a guide pin as well as a shifting mean FIG. 4—A schematic side view of a drop down platform with a set of cantilever pivot arms and cylinder attached to a console a control arm, connected to the pivoting arm and to the platform as well as a shifting mean FIG. 5—A schematic side view of a drop down platform with a set of cantilever pivot arms and cylinder attached to a console as well as cranked pivoting arm attached to the platform, which is hinged to the platform chassis and to the panel as well as an additional cantilever between the panel and the platform chassis FIG. 6—A schematic side view of a drop down platform with a set of cantilever pivot arms and cylinder attached to a console as well as cranked pivoting arm attached to the platform which is hinged to an intercarrier which is mounted to the panel as well an additional cantilever between the intercarrier and the platform chassis.

FIG. 2 shows a schematic view of a drop down platform 1 with a cantilever arm 6 attached to a console 5, identical to FIG. 1, with the difference that the lengthwise shifting of panel 2 takes place by means of a gear 11, which is firmly attached to one of the pivoting arms 6*a* or 6*b*, depicted here with pivoting arm 6*a*. Due to the pivoting caused by activating cylinder 7, the gear 11 undergoes a process of unwinding on the gear racks 12 attached under panel 2, which have a gear evolvent that meshes properly into gear 11. Thus, panel 2 shifts under coercion by means of shifting means 10 placed between this and platform chassis 3, which can be a gliding or rotating bearing. Because of the limited lift H1 of the drop down platform 1, not very large meshing distances can be achieved with such gear 11 and, therefore, large shifting distances cannot be effectuated with the panel 2. Therefore, between gear 11 and gear rack 12, a reduction gear 13 is placed and fixed onto platform chassis 3, which transforms the limited pivoting angle and meshing distance on gear 11 into a higher speed, and thereby generates additional meshing distance. This reduction gear 13 can be a planetary gear which can be built very short and allows a realistic gear reduction. Therefore, additionally to the deflection radius of pivoting arms 6*a*, 6*b* achieved from shifting mechanically from position A to position B, a total shifting length of panel 2 away from transom 4 according T2 can be achieved.

Figure 3:
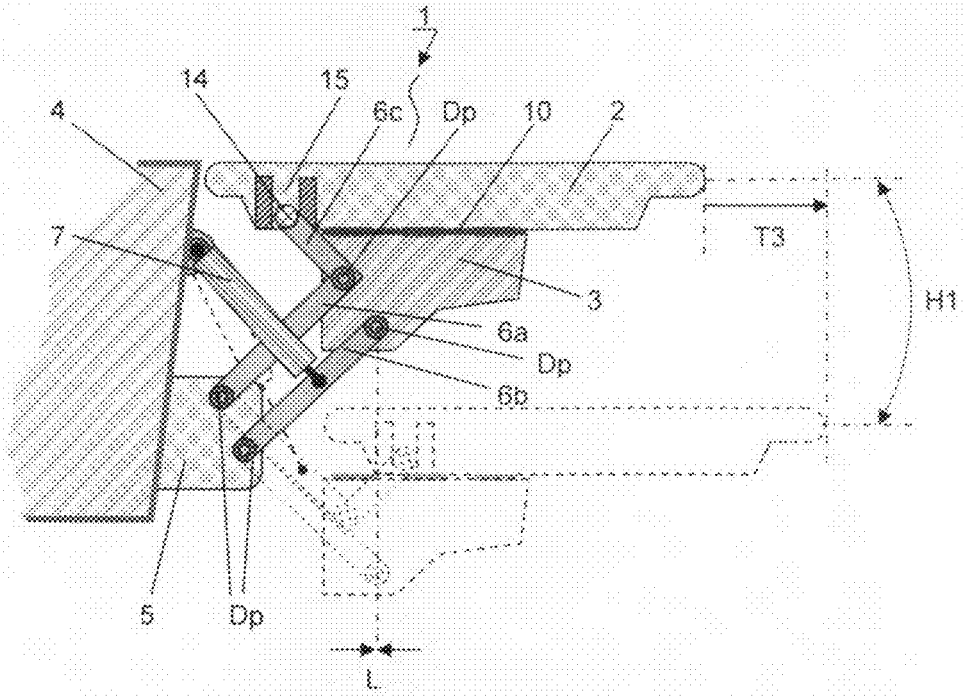

FIG. 3 shows a schematic view of a drop down platform 1 with a cantilever arm 6 attached to a console 5. A cranked pivoting element 6*c* is attached and hinged to the platform chassis 3. The pivoting arm 6*b* connects via the pivot point Dp to the console 5, and connects to the platform chassis 3 and is set in motion and held also in position by cylinder 7. By generating a pivoting motion on the cantilever arm 6 and generating a lift H1, the pivoting element 6*c* pivots arcwise on the platform chassis. At the end of element 6*c* there is positioned a guide pin 14, which slots into the guide nut 15 attached on panel 2. According to the arc movement of pivoting element 6*c* creating the deflection radius and offsets the height difference in the guide nut 15, the panel 2 shifts mechanically parallel and linear to the platform chassis 3 on the shifting means 10. The total shifting distance of the panel 2 away from transom 4 is, in this case, T3.

Figure 4:
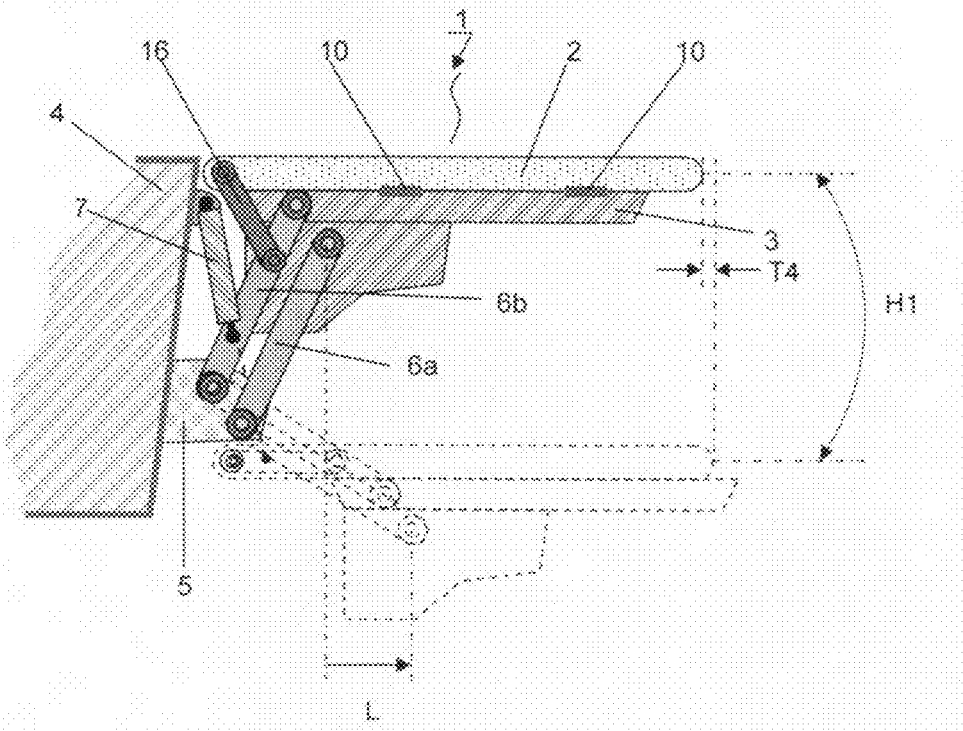

FIG. 4 shows a schematic view of a drop down platform 1 with cantilever arms 6 attached to a console 5 on which a control lever 16 is attached and which is fixed to panel 2. By pivoting the cantilever arms 6 by activating cylinder 7, a lift H1 is generated, on which the control lever 16 generates a compensating function between pivoting arm 6*a* and the shiftable panel 2. During a lifting operation H1, a nonlinear shifting away from transom 4 of the platform 1 is desired, but the platform 1 stays as close as possible to transom 4 so that the gap between transom 4 and the platform 1 is kept as small as possible while lowering or lifting the platform 1. By adequately placing the control lever 16 relative to the cantilever arms 6, a possible larger or smaller linear shifting distance of the panel 2 is generated, and may cause a positive shifting i.e. away from transom 4, or a negative shifting i.e. toward the transom 4. A minimal positive shifting T4 is shown in FIG. 4.

Figure 5:
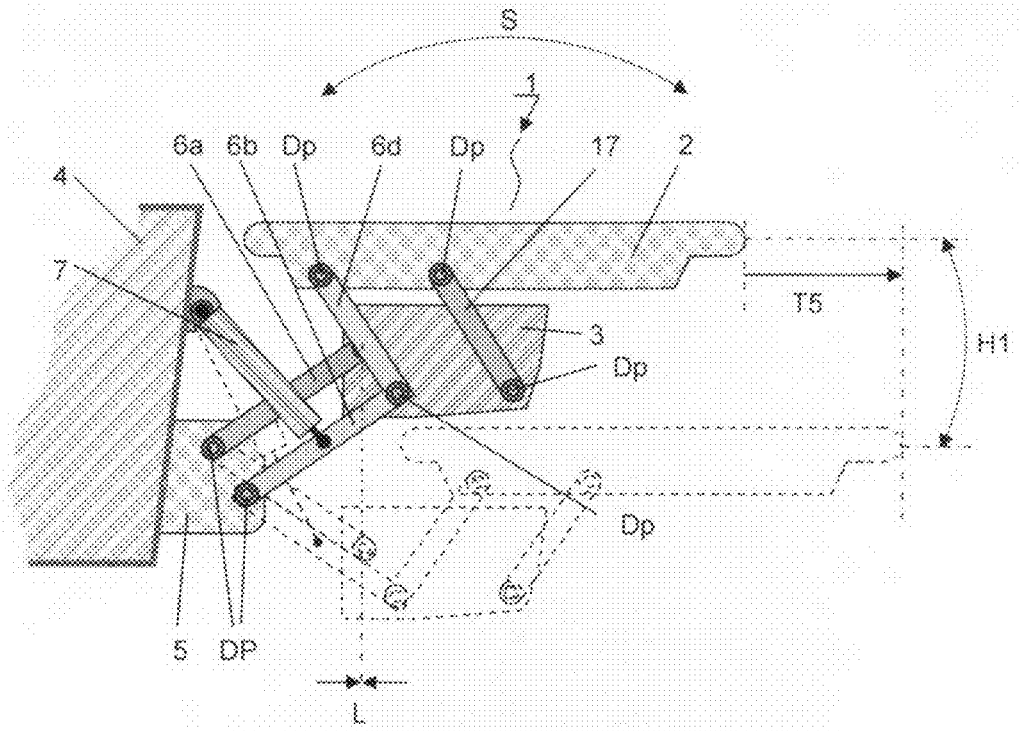

FIG. 5 shows a schematic view of a drop down platform 1 with cantilever arms 6 attached to console 5. The pivoting arm 6*b* generates an angle with a cranked pivoting element 6*d* and is fixed and hinged to the platform chassis 3. The pivoting arm 6*b* is hinged to console 5 and keeps platform chassis 3 in position by means of cylinder 7. By pivoting the cantilever 6, a lift H1 is generated, which sets the pivoting element 6*d* arcwise into motion on platform chassis 3. This effect is used, in that, at the end of the pivoting element 6*d*, the panel 2 is attached and hinged onto it. Parallel to pivoting element 6*d*, operates an additional pivoting lever 17, hinged and fixed onto platform chassis 3 and panel 2 so that, when pivoting the cantilever arms 6, in addition to the lift H1, the pivoting element 6*d* allows, at the same time, the panel 2 to pivot away from the transom 4 in an arc-like manner shown by way the arc arrow S. The total distance T5 of panel 2 away from transom 4 comprises of a deflection radius L of the cantilever arms 6 and arc-like shaped and lengthwise shifting S of the panel 2. The advantage of this construction is that no shifting parts have to be exposed to sea water and therefore pivoting elements can be sealed much easier with O-rings.

Figure 6:
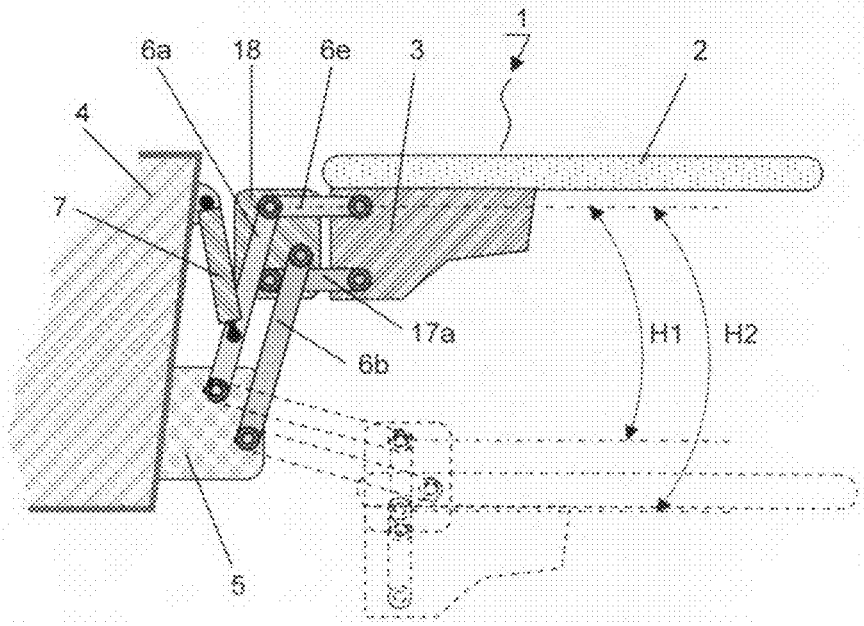

FIG. 6 shows a schematic view of a drop down platform 1 with cantilever arms 6 attached to console 5. One of the pivoting arms, shown here as pivoting arm 6*a*, has a cranked pivoting element 6*e*. Pivoting element 6*e* is attached and hinged to platform chassis 3 and is connected to cylinder panel 18, in addition to which a pivoting lever 17*a* is also attached and is also hinged to platform chassis 3 so as to ensure that the platform 1 remains horizontal when pivoting the pivoting arms 6*a*, 6*b*. By pivoting arm 6*a* using the attached cylinder 7, the platform 1 will generate a lift H. The result is that the cantilever arms 6 creating a lift H1, when pivoting the pivoting arm 6*a* with pivoting element 6*e*, a pivoting movement on the pivoting element 6*e* is generated which, according to the length of pivoting element 6*e*, creates an additional lift and thereby platform 1 reaches a total lift H2.

In this manner it is possible to reach an additional coercion controlled lift with a given cylinder length or pivoting arm length, whereby an additional stroke may be achieved by introducing a gear combination or steering bar implementation.

Figure 7:
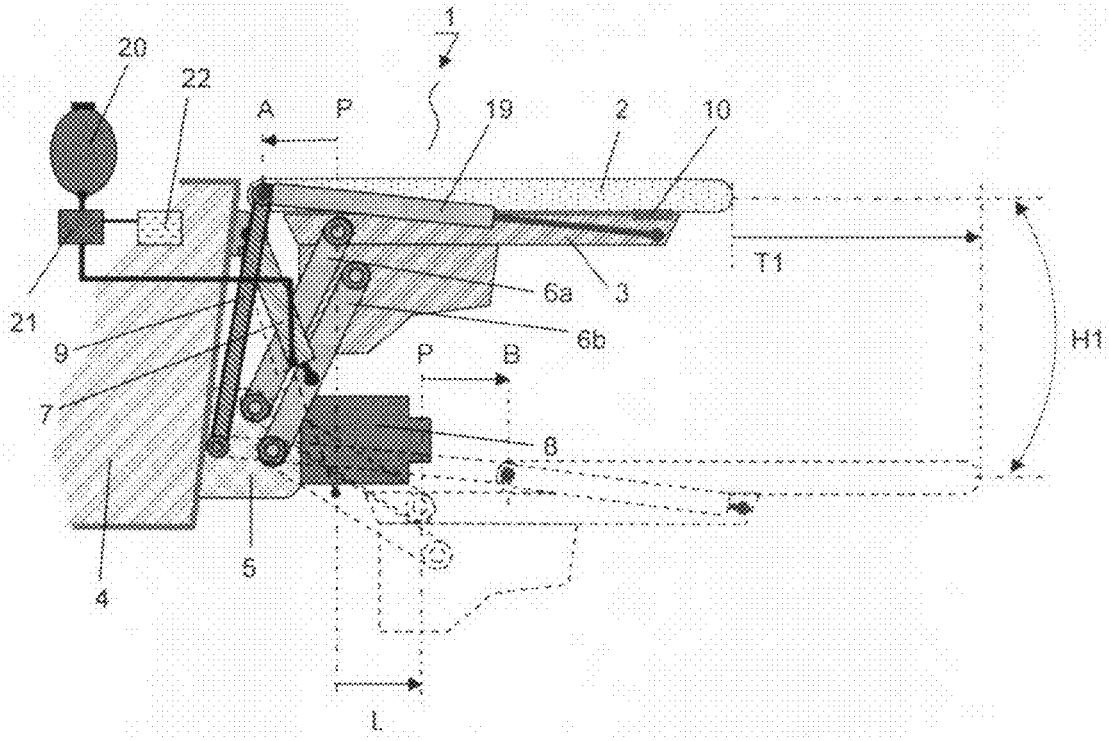
FIG. 7—A schematic side view of a drop down platform with a set of cantilever pivot arms attached to a console and cylinder, as well a steering bar between the console and the platform, a shifting mean and two lifting storage mean variances.

FIG. 7 is a schematic side view of a drop down platform 1 consisting of a panel 2 and a platform chassis 3 carried by a set of cantilever pivot arms attached and hinged to a console 5 and all of it attached to the transom 4 of a watercraft. The steering bar 9 triggers, while pivoting the platform 1 by the cylinder 7, the shifting stroke from A to B between the panel 2 and the platform chassis 3. In an energy storage 19 e.g. a gas spring, the gas will be compressed and stored. In case of a hydraulic or electric failure, the gas in the energy storage 19 can expand again and lifts, by crossing the panel 2 over the platform chassis 3, the platform 1 up to the upper limit, namely, to position A. This function may be used for the other horizontal shifting means as well.

Another way to store energy is to do it directly at the cylinder 7, by means in case the cylinder rod is pushed out for lifting lift H1, the fluid, most of the time oil, the oil in the counterchamber will not flow into the tank 22, but into an accumulator 20. The accumulator 20 is set in such a way, that it can at least lift the weight of the platform 1 to the position A and the power is higher than the weight of the platform 1. The accumulator 20 can be used in a stand by position by means of a valve 21 locking the exit of the accumulator 20, thus the fluid is transported as usual into the tank 22 and only in case of emergency, the valve 21 will be opened, at the same time the line to the tank 22 is blocked to have the requested pressure and oil volume in the cylinder 7 to lift the platform 1.

As described herein above and as can now be appreciated, a coercion means 9, 11, 6*c*, 6*d*, 6*e* or 16 is provided and is pivotally connected to the panel 2 so that, by lowering of the panel 2, the panel is restraint guided to a lengthwise movement at the transom of the watercraft.

Of course the invention is not only applicable on shown and described examples

DRAWING LIST

1 Platform
2 Panel
3 Platform chassis
4 Transom
5 Console
6 Cantilever arms
6*a*,6*b* Pivoting arm
6*c*,6*d*,6*d*,6*e* Pivoting element
7 Cylinder
8 Technical mean
9 Steering bar
10 shifting mean
11 Gear
12 Gear rack
13 Reduction gear
14 Guide pin
15 Guide nut
16 Control lever
17 Pivoting lever
18 Cylinder panel
19 Energy storage
20 Accumulator
21 Valve
22 Tank
H1,2 Lift
Dp Pivot point
S Arc
T1-5 Total horizontal shifting

The invention claimed is:

1. A drop down transom platform for a watercraft that includes a transom and a console attached to the transom, the transom platform comprising:

a panel;

a platform chassis on which the panel rests, wherein the panel is movable horizontally relative to the platform chassis;

at least two pivoting arms, wherein the pivoting arms are pivotally arranged at one end to the console and are pivotally arranged at another end to the platform chassis so that the pivoting arms maintain a parallel orientation when the platform chassis is raised or lowered;

a lifting cylinder, wherein one end of the lifting cylinder is connected to the transom and another end of the lifting cylinder is connected to the pivoting arms so that when the lifting cylinder is operated, the pivoting arms raise or lower the platform chassis; and coercion control means connected to the panel so that, when the pivoting arms raise or lower the platform chassis, the panel is maintained at a horizontal attitude relative to the horizon and the panel moves horizontally relative to the platform chassis, wherein:

the coercion control means comprises a steering bar and an additional pivoting element, the steering bar is connected at one end to the console and is pivotally connected at another end to the panel, and the steering bar is arranged so that, by pivoting the additional pivoting element by pivoting the pivoting arms, the panel is raised and lowered and moves horizontally relative to the platform chassis while being maintained at the horizontal attitude.

2. A drop down transom platform for a watercraft that includes a transom and a console attached to the transom, the transom platform comprising:

a panel;

a platform chassis on which the panel rests, wherein the panel is movable horizontally relative to the platform chassis;

at least two pivoting arms, wherein the pivoting arms are pivotally arranged at one end to the console and are pivotally arranged at another end to the platform chassis so that the pivoting arms maintain a parallel orientation when the platform chassis is raised or lowered;

a lifting cylinder, wherein one end of the lifting cylinder is connected to the transom and another end of the lifting cylinder is connected to the pivoting arms so that, when the lifting cylinder is operated, the pivoting arms raise or lower the platform chassis; and coercion control means connected to the panel so that, when the pivoting arms raise or lower the platform chassis, the panel is maintained at a horizontal attitude relative to the horizon and the panel moves horizontally relative to the platform chassis, wherein:

the coercion control means comprises an additional pivoting element that is mounted so as to have a fixed angle to one of the pivoting arms and is pivotally connected to the panel, and the coercion control means further comprises a guide nut, wherein the guide nut is arranged such that, by pivoting the additional pivoting element by pivoting the pivoting arms, the panel is raised and lowered and moves horizontally relative to the platform chassis while being maintained at the horizontal attitude.

3. A drop down transom platform for a watercraft that includes a transom and a console attached to the transom, the transom platform comprising:

a panel;

a platform chassis on which the panel rests, wherein the panel is movable horizontally relative to the platform chassis;

at least two pivoting arms, wherein the pivoting arms are pivotally arranged at one end to the console and are pivotally arranged at another end to the platform chassis so that the pivoting arms maintain a parallel orientation when the platform chassis is raised or lowered;

a lifting cylinder, wherein one end of the lifting cylinder is connected to the transom and another end of the lifting cylinder is connected to the pivoting arms so that, when the lifting cylinder is operated, the pivoting arms raise or lower the platform chassis; and coercion control means connected to the panel so that, when the pivoting arms raise or lower the platform chassis, the panel is maintained at a horizontal attitude relative to the horizon and the panel moves horizontal relative to the platform chassis, wherein:

the coercion control means comprises an additional pivoting element that is mounted so as to have a fixed angle to one of the pivoting arms and is pivotally connected to the panel, the coercion control means further comprises a pivoting lever, wherein the additional pivoting element and the pivoting lever are arranged so that, by pivoting the additional pivoting element by pivoting the pivoting arms, the panel is raised and lowered and moves horizontally relative to the platform chassis while being maintained at the horizontal attitude.

* * * * *